United States Patent [19]

Cohen et al.

[11] 4,012,205

[45] Mar. 15, 1977

[54] THICKENED HYDROCARBON FUELS

[75] Inventors: Leonard Cohen, Bel Air, Md.; William J. Connick, Jr., New Orleans, La.

[73] Assignee: The United States of America as represented by the Secretary of the Army, Washington, D.C.

[22] Filed: Jan. 5, 1966

[21] Appl. No.: 519,171

[52] U.S. Cl. ..... 44/7 C; 44/7 E
[51] Int. Cl.[2] ..... C10L 7/00; C10L 7/02
[58] Field of Search ..... 44/7, 7 C; 149/109

[56] References Cited

UNITED STATES PATENTS

| | | | |
|---|---|---|---|
| 3,219,619 | 11/1965 | Dickerson | 149/109 X |
| 3,274,161 | 9/1966 | Kramer et al. | 44/7 C X |

*Primary Examiner*—Leland A. Sebastian
*Attorney, Agent, or Firm*—Nathan Edelberg; Robert W. Church

[57] ABSTRACT

New composition of matter and method of preparation thereof consisting essentially of a liquid hydrocarbon and a reaction product of tolylene diisocynate with a mixture of $\beta$-amino derivatives of 15–20 carbon n-alkanes and having utility as a semi-solid hydrocarbon fuel for devices such as flamethrowers and fire bombs.

8 Claims, No Drawings

THICKENED HYDROCARBON FUELS

This invention relates to the art of gelling combustible liquid hydrocarbons and to the resultant product.

The literature and patents in this field of endeavor are quite extensive. Various agents have been proposed in the past such as soaps of sodium, potassium, calcium, and aluminum. Other thickening agents have been suggested such as metal salts of polyacrylic acid, wax oxidates, polypropylene, polyamides, and lanosterol. Of all the proposed thickening agents the one which has met with the greatest success is the mixture of aluminum soaps disclosed by Fieser in U.S. Pat. No. 2,606,107, which mixture is now called napalm.

The use of napalm has been quite extensive but its use has certain disadvantages in that the dry napalm powder has a tendency to absorb water and cake during storage. Also the napalm must be thoroughly mixed with the liquid hydrocarbon it is to be used with. See for example, the patent to Coffman U.S. Pat. No. 2,750,073, which discloses a mixing apparatus for napalm. Finally, the napalm-hydrocarbon mixture must be aged for 12–24 hours before it can be used.

In view of the above, it is the primary object of our invention to provide a novel process for thickening of liquid hydrocarbons whereby the thickening agents are all liquids and they react in situ to form a polymer in a matter of 10 minutes with only a gentle shaking of the container.

Another object of our invention is to provide a gelled or semi-solid hydrocarbon fuel which is useful in flamethrowers and fire bombs.

Other objects of our invention are readily apparent or will become obvious from a study of the description of our invention.

We have found that normally liquid hydrocarbons such as gasoline, kerosene, fuel oil, benzene, naphthas, etc. can be quickly gelled in one adds a liquid amine mixture of oleylamine or linoleylamine with the bis(3-aminopropylamino) derivative of dimerized linoleyl acid; oleylamine or linoleylamine with a 1,4-di(aminomethyl)-cyclohexane or menthane diamine; or a mixture of $\beta$-amino derivatives of 15–20 carbon n-alkanes to tolylene diisocyante dissolved in the liquid hydrocarbon. Obviously, the order of adding the amine mixture and the tolylene diisocyante to the liquid hydrocarbon is immaterial and can be reversed.

One of the principal advantages of our gels is that although they are equal to napalm thickened fuel in such characteristics as "rod length" and "center of deposit", they are much easier and faster to prepare than the conventional napalm fuels as will be disclosed herein. The terms "rod length" is defined as the length of the coherent mass of flaming fuel as it leaves the flamethrower. The terms "center of deposit" refers to the center of the spray pattern of the flamethrower. Obviously, there are deposits from over-spraying and deposits from under spraying. This term gives the mean length between these extremes and is a useful measure of the effective range of the fuel.

For the purposes of this application, the terms "bis(3-aminopropylamino) derivative of dimerized linoleyl acid" are designed to be descriptive of the "dimer tetramine" produced and sold by the Chemical Division of General Mills, Inc. This dimer is the complex final product of the controlled dimerization of linoleyl acid followed by the conversion to the 3-amino-propylamino derivative. This dimer can be illustrated by the formula:

$$H_2N-(CH_2)_3-NH-R-NH-(CH_2)_3-NH_2$$

where R is a 36 carbon hydrocarbon radical.

This mixture has the following physical properties which will serve to better identify it.

| | |
|---|---|
| Amine number (mg KOH eq. to 1gm. of amine) | 319 |
| Iodine value | 103 |
| Gardner color | 6–7 |
| Pour point ASTM | −5° F |
| Viscosity 30° C | 360cp |
| Specific gravity | 0.903 |

Furthermore, the terms "$\beta$-amino derivatives of 15–20 carbon n-alkanes" are designed to be descriptive of the "Armeen L-15" produced and sold by the Armour Industrial Chemical Company. These $\beta$-amine mixtures can be illustrated by the following formula:

$$R-\underset{\underset{NH_2}{|}}{CH}-CH_3$$

where R is a normal alkyl group of 15–20 carbons. They have the following physical properties:

| | |
|---|---|
| Gardner color | 2max. |
| Melting point | +50° F |
| Cloud point | +54° F |
| Neutralization equivalent | $295_{max.}$ |
| Amine value | $190_{min.}$ |
| Specific gravity | 0.813 |
| Pounds per gallon | 6.79 |

For convenience, we will use the terms "dimer tetramine" and "1-15" hereinafter since the meaning of these terms is established above.

In this specification when we refer to tolylene diisocyante (hereinafter abbreviated as "T.D.I.") we mean the commercial grade of TDI which comprises a 65:35 ratio of the 2,4 isomer to the 2,6 isomer.

We have further found that out method is a very convenient method to use in military operations since the operator of a portable flamethrower merely has to pour the above chemicals into his flamethrower tank and shake it for about 20 sec. In about 10 minutes, the gel sets up and is ready to be used. We have found also that the gel remains viscoelastic for about 3 days after mixing and it appears to become more rigid very slowly after the initial rapid 10 minute gelling time.

Obviously, this invention can be applied to firebombs where there is apparatus to stir the reactants in the bomb or to agitate the entire bomb.

In general, we consider the dimer tetramine, methane diamine, and the 1,4-di(aminomethyl) cyclohexane as polyamine cross-linking agents and they are added in relatively minor amounts compared to the amount of the main amine, oleylamine, or linoleylamine.

For reasons unknown to us, in the use of L-15 amine one does not need a polyamine cross-linking agent and gels made by this technique are equal to or superior to the others.

In general, we have found that good gels are obtained when one adds about 3–6% (by weight of the hydrocarbon) of a mixture of the amines to the hydrocarbons along with about 1–2% of the toluene diisocyante. The ratio of the toluene diisocyante to the amine mixtures should be 1 to 3 or 4 so that if a 4% gel is desired (4% reaction product based on the weight of hydrocarbon) about 1% should be T.D.I. and 3% or about 4% should be the desired amine mixture. We have further found that if a polyamine cross-linking agent is desired to be used it should be present in the range of about 3–10% of the oleylamine or linoleyamine used.

As is well known, a fire bomb fuel is generally made more viscoelastic than a portable flamethrower fuel. We have further found that our 8% thickened fuels are excellent for suspending fuel additives such as powdered aluminum, magnesium and their alloys as well as oxidizing agents such as ammonium, sodium, and potassium perchlorate or nitrates. The advantage of using our thickened hydrocarbons is that the agents remain suspended over a long period of time with no evidence of settling out as has been observed with the aluminum soap gels of the prior art.

The following examples are merely illustrative of our invention are not to be construed as being a limitation on the scope of our invention.

EXAMPLE 1

A mixture of 157 grams of oleylamine and 11 grams of dimer tetramine were added to 2 gallons of regular leaded gasoline in a flamethrower fuel tank with constant shaking. After the mixture was thoroughly mixed, 56 grams of T.D.I. were added with additional shaking. The mixture rapidly set to a gel in about 10 minutes and was ready for firing in about thirty minutes.

When the flamethrower was subsequently fired, the flaming gelled gasoline had a rod length of 35–40 yards with an elliptical deposit pattern that ranged from 40–54 yards with the center of deposit at about 47 yards.

If linoleylamine is substituted for oleylamine, equal results are obtained.

EXAMPLE 2

Into 2 gallons of regular gasoline, in a flamethrower fuel tank, were poured 161 grams of oleylamine and 5 grams of menthane diamine. After shaking the flamethrower for 20 seconds, 57 grams of commercial grade T.D.I. were added and the shaking was continued for 20 seconds until the mixture set up to a viscous gel.

After about 30 minutes, the fuel was fired on a test range. It had a rod length of 40 yards and a center of deposit of 50 yards.

If 1,4-di(aminomethyl) cyclohexane is substituted for the menthane diamine, or if linoleylamine is substituted for oleylamine, equal results are obtained.

EXAMPLE 3

Into 2 gallons of regular grade gasoline in a flamethrower fuel tank is poured 166 grams of "L-15" with constant shaking. After this mixture is mixed, 49 grams of commercial T.D.I. is poured into the container followed by more shaking. In about 10 minutes a gel formed and it was fired on a test range in thirty minutes. The rod length was 40 yards and the center of deposit was 40 yards.

Obviously, one skilled in this art can modify and vary the invention set forth above without departing from the spirit and the letter of the specification. The invention should be limited solely by the scope of the appended claims.

We claim:

1. A composition of matter consisting essentially of a combustible liquid hydrocarbon and a reaction product of tolylene diisocyante with a member of the group of consisting of:

a. a mixture comprising a member of the group consisting of oleylamine and linoleylamine with the bis(3-aminopropylamino) derivatives of dimerized linoleyl acid, b. a mixture comprising a member of the group consisting of oleylamine and linoleylamine with a member of the group consisting of 1,4-di(aminomethyl) cyclohexane and menthane diamine, c. a mixture of $\beta$-amino derivatives of 15–20 carbon n-alkanes.

2. A composition of matter consisting essentially of a combustible liquid hydrocarbon and a reaction product of tolylene diisocyante with a mixture comprising a member of the group consisting of oleylamine and linoleylamine with bis(3-aminopropylamino) derivative of dimerized linoleyl acid.

3. A composition of matter consisting essentially of a combustible liquid hydrocarbon and a reaction product of tolylene diisocyante with a mixture comprising a member of the group consisting of oleylamine and linoleylamine with a member of the group consisting of 1,4-di(aminomethyl) cyclohexane and menthane diamine.

4. A composition of matter consisting essentially of a combustible liquid hydrocarbon and a reaction product of tolylene diisocyante with a mixture of $\beta$-amino derivatives of 15–20 carbon n-alkanes.

5. A method for the thickening of hydrocarbon fuels which comprises:

a. adding to a hydrocarbon fuel an amine mixture selected from the group consisting of:

1. a member of the group consisting of oleylamine and linoleylamine with the bis (3-aminopropylamino) derivative of dimerized linoleyl acid,
2. a member of the group consisting of oleylamine and linoleylamine with a member of the group consisting of 1,4-di(aminomethyl) cyclohexane and menthane diamine,
3. a mixture of $\beta$-amino derivatives of 15–20 carbon n-alkanes;

b. shaking the mixture until complete solution occurs;

c. adding tolylene diisocyante;

d. shaking the mixture until thickening takes place.

6. The method as set forth in claim 5 in which the amine mixture is oleylamine with the bis(3-aminopropylamino) derivative of dimerized linoleyl acid.

7. The method as set forth in claim 5 in which the amine mixture is oleylamine with menthane diamine.

8. The method as set forth in claim 5 in which the amine mixture consists of the $\beta$-amino derivatives of 15–20 carbon n-alkanes.

* * * * *